United States Patent [19]

Hatton

[11] Patent Number: 4,612,779

[45] Date of Patent: Sep. 23, 1986

[54] MOBILE ICE PLANT

[76] Inventor: James R. Hatton, 6700 N. 14th La., McAllen, Tex. 78504

[21] Appl. No.: 750,307

[22] Filed: Jul. 1, 1985

[51] Int. Cl.[4] ..... F25C 5/18

[52] U.S. Cl. ..... 62/344; 241/101.7; 296/26; 296/27

[58] Field of Search ..... 62/344, 448; 414/332; 296/26, 27, 171, 175; 241/101.7

[56] References Cited

U.S. PATENT DOCUMENTS

| | | | |
|---|---|---|---|
| 2,538,736 | 10/1944 | Spencer et al. | 296/23 |
| 2,739,833 | 3/1956 | Schenkel et al. | 296/27 X |
| 3,586,181 | 6/1971 | Brock | 414/332 |
| 3,746,395 | 7/1973 | McClaren | 296/26 X |
| 3,797,267 | 3/1974 | Hagen | 62/344 X |
| 3,966,075 | 6/1976 | Schultz | 296/26 X |
| 4,133,571 | 1/1979 | Fillios | 296/26 X |
| 4,404,817 | 9/1983 | Cox | 62/320 |

*Primary Examiner*—William E. Tapolcai

*Attorney, Agent, or Firm*—Pravel, Gambrell, Hewitt & Kimball

[57] ABSTRACT

A mobile ice plant for making and discharging ice at remote locations. The ice plant includes a mobile ice storage bin adapted to be disposed underneath ice-making means. The ice-making means is stored within the storage bin during transportation and lifted above the storage bin when making and discharging ice.

13 Claims, 4 Drawing Figures

14
39
38
5
6
7
2
34
17
31
32
18
4
9
B
21
15
19
16
15a
S
30a
22
20
10
8
14
3
2

MOBILE ICE PLANT

FIELD OF THE INVENTION

This invention relates to the production and distribution of ice. Specifically, this invention relates to ice-making and storage equipment that can be transported to remote locations.

BACKGROUND OF THE INVENTION

The use of ice as a cooling medium for fresh vegetables, sea food, concrete and many other commodities has increased rapidly. At the same time, many of the traditional block ice plants providing 300 pound bars of ice have become obsolete. These plants are usually replaced by more efficient fragmented ice or flake ice plants.

Although fragmented or flaked ice can be conveyed into trucks or trailers and hauled to remote locations, removal of the product is difficult and labor intensive due to the packe plants since 1980 and it is the object of this invention to provide a completely mobile ice plant which can be quickly and easily moved from one location to another.

SUMMARY OF THE INVENTION

The present invention is a mobile ice plant for making and discharging ice at remote locations, comprising ice-making means, a mobile ice storage bin adapted to be disposed underneath said ice-making means to receive ice manufactured by said ice-making means when the ice plant is in its ice-making position, lifting means for raising and lowering said ice-making means from a storage position within said storage bin to an ice-making position above said storage bin, and ice handling means mounted within said storage bin to discharge ice from said bin.

DETAILED DESCRIPTION OF THE INVENTION

Figure 1:
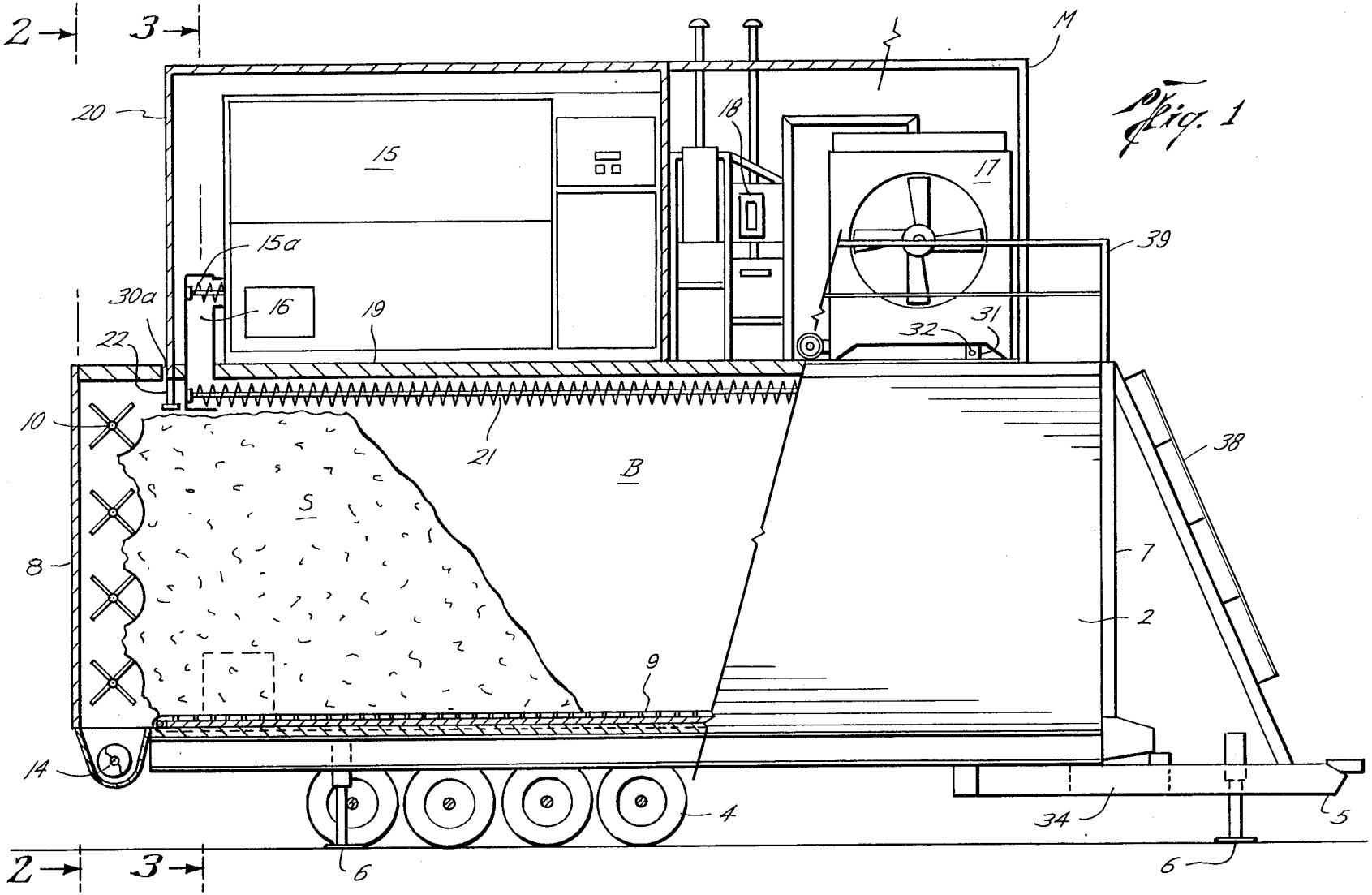
FIG. 1 is a side view of a preferred embodiment of the invention, including the interior components, with the ice-making means positioned above the storage bin.

The preferred embodiment of this invention includes an ice storage bin B and an ice-making assembly M which is adapted to be raised and lowered with respect to the storage bin B.

The ice storage bin B is preferably fabricated from galvanized steel panels 2 and lined on the inside with an insulating material such as high molecular weight polyethylene sheets (not shown). The polyethylene sheets provide a smooth non-stick surface. Additional insulation is provided by blowing urethane insulation into spaces in the walls, roof, and floor.

The storage bin B is preferably mounted on heavy duty wheel units 4 complete with brakes. Alternatively, the storage bin B is mounted on skids which may be transported on lowboy trailers. The storage bin B is provided with a heavy duty towing hitch 5, support members with lifting jacks 6, signal and marker lights and plexiglass viewing windows.

The ice storage bin B receives ice from the ice-making assembly M and is adapted to discharge the ice to subsequent ice handling devices such as snow blowers or bagging equipment (not shown). Ice S stored within the bin B is moved toward the rear 8 of the bin by ice conveying chains 9 mounted on the floor of the bin. The conveying chains 9 are preferably made of galvanized steel and are the same kind of chains used in lumber and pulpwood mills for conveying logs and wood products. The chains 9 traverse idler and power sprockets (not shown) mounted in the floor of the bin B. The power sprockets are driven by an electric motor contained within a drive unit U mounted on the side of the storage bin B.

The conveying chains 9 move the ice stored within the bin B toward ice breaker bars 10 mounted at the rear 8 of the bin. A drive chain mounted within compartment 12 (FIG. 2) on the side of the bin B traverses sprockets mounted on the end of each breaker bar 10. The drive chain is powered by an electric motor contained within power unit U. The breaker bars 10 break the bridging and fusing of the ice allowing the ice to fall into an ice discharge screw conveyor 14. The discharge screw conveyor 14 is mounted below the floor level of the bin B and is directly below the breaker bars 10.

The ice-making assembly M preferably includes two commercial ice makers 15 capable of producing fragmented ice. The "Ice Master ®" produced by Morris & Associates has performed well and includes an auger **15*a* which crushes and transports ice from the ice maker 15. A feed hopper 16 is mounted with the ice makers 15 to receive ice from the augers 15*a*. The ice-making apparatus M further includes a cooling tower 17 and electrical controls complete with weatherhead 18**.

Figure 2:
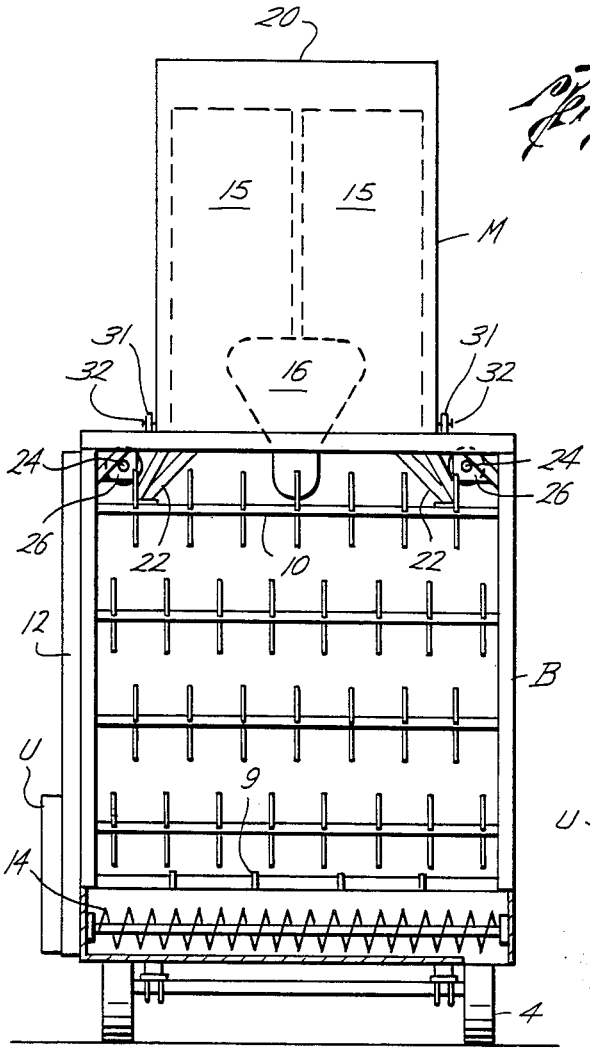
FIG. 2 shows a schematic end view of FIG. 1 including the interior components.
Figure 3:
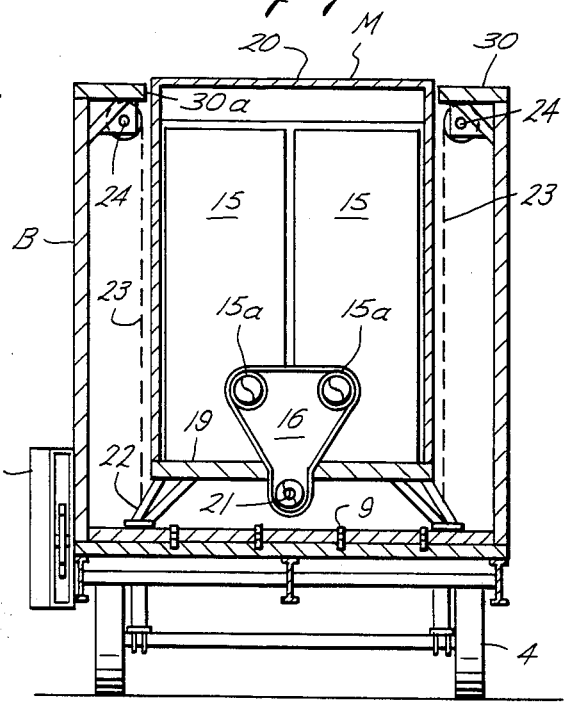
FIG. 3 shows a cross-sectional view of FIG. 1 with the ice-making means positioned within the storage bin.

The ice makers 15 and cooling tower 17 are mounted on a rigid base 19 of steel or similar material and are contained within a housing 20 of steel or other material. The feed hopper 16 extends through the base 19 which forms a portion of the roof of the storage bin B when the ice-making apparatus M is in its ice-making position as shown in FIGS. 1 and 2. An ice feeding screw 21 is mounted on the bottom of the base 19 of the ice-making assembly M. The feeding screw 21 functions to distribute ice toward the front 7 of the storage bin B when a mound of ice S reaches the bottom of the feed hopper 16. The base 19 includes four support legs 22 that extend below the leveling screw 21 so that the feeding screw 21 is positioned above the floor of the storage bin B when the ice-making assembly M is in its storage position as shown in FIG. 3.

For the purpose of raising and lower the ice-making assembly M relative to the storage bin B, wire rope cables are attached to the assembly M, preferably at the support legs 22. The cables 23 on each side of the assembly M are wound around a shaft 24 that is rotatably mounted with the storage bin B. Preferably, each shaft is supported by bearings 25 mounted in brackets 26 at each end of the shaft 24. The brackets 26 are welded or are otherwise fixed to the roof 30 of the storage bin B. The roof 30 has an opening **30*a* of a size to receive the ice-making assembly M so that the assembly M may move between its ice-making position (FIG. 1) and its storage position (FIG. 3**).

Figure 4:
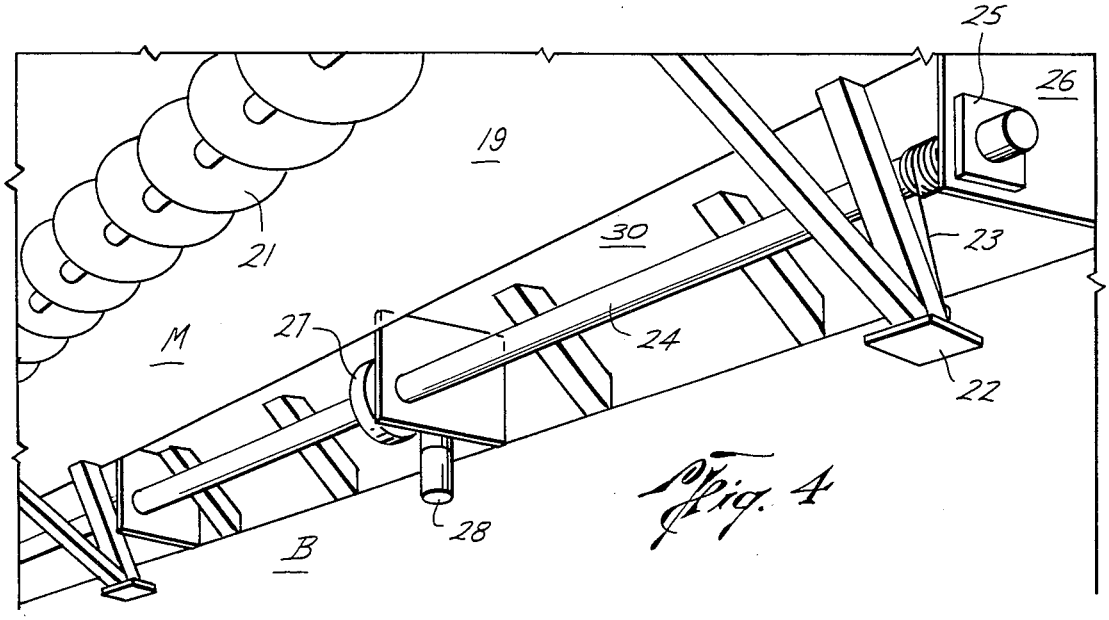
FIG. 4 shows a perspective view of a portion of the lifting means located within the storage bin.

A shaft mounted worm gear reducer 27 driven by a hydraulic motor 28 (FIG. 4) turns each shaft 24 to wind or unwind the cables 23 thereby raising or lowering the ice-making assembly M relative to the storage bin B. To hold the assembly M in its ice-making position above the storage bin B, holding brackets 31, preferably angle irons, are welded or are otherwise secured to the roof 30 adjacent the opening 30*a*. Each bracket 31 has a horizontal hole for receiving a removable latch pin 32. The latch pins 32 extend through the holes in the brackets 31 and into aligned holes in the base 19 so that the assembly M is securely held in its ice-making position. Preferably, three holding brackets 31 are positioned along the opening 30*a* on each side of the ice-making assembly M.

A hydraulic system 34 of any known construction supplies power to the hydraulic motors 28 for raising or lowering the cables 23 and thus the ice-making assembly M.

An access ladder 38 and safety rails 39 are provided for safe access to the ice-making assembly M when in its ice-making position.

Electrical controls (not shown) mounted on the side of the bin B activate the hydraulic system 34 and the electrical motors mounted in the power unit U. Safety interlocks prevent operation of the various components in an improper sequence.

In the use of the apparatus of this invention, the ice-making assembly M is disposed entirely within the ice storage bin B during transportation to a selected point where it is desired to make and distribute ice. For example, ice is often desired at remote locations such as farms where the produce from the fields must be kept cool or packaged in ice for shipping.

When the apparatus reaches a selected location, the hydraulic motors 28 on each of the shafts 24 are operated to wind up the cables 23 onto the shafts 24 and to thereby lift the assembly M to its raised ice-making position (FIGS. 1 and 2). When that position is reached, the latching pins 32 are inserted through the brackets 31 and into the base 19 to securely hold the assembly M in the ice-making position.

While in the ice-making position, the ice makers 15 make ice in the usual way. The ice is discharged from the ice makers 15 by augers 15*a*, through feed hopper 16, and into the storage bin B. The feeding screw 21 transports the ice from the feed hopper 16 toward the front of the storage bin B. The ice-making assembly M can be operated independently of the equipment for discharging ice from the bin B until the storage bin B has been substantially filled, if so desired.

When ice is to be discharged from the bin B, the ice conveying chains 9 located on the floor of the bin B are activated to move the ice S toward the rear 8 of the storage bin. The ice breaker bars 10 are rotated as the ice S is forced into them by the conveying chains 9 and break up any fusion and bridging between ice fragments. The ice fragments fall from the breaker bars 10 into the screw conveyor 14 for discharge from the storage bin B to any suitable external conveyor or other equipment such as snow blowers or baggers.

After the ice is all discharged from the storage bin B, the apparatus can be prepared to move to another location. To lower the ice-making assembly M, the latching pins 32 are removed from the brackets 31. The hydraulic system 34 is activated and allows the cables 23 to unwind from the shafts 24 until the support legs 22 rest on the floor of the storage bin B. In this position (FIG. 3), the overall height of the apparatus is reduced sufficiently for transportation on highways, under overpasses and below other low clearance areas.

The support members with conventional lifting jacks 6 may be used to support the apparatus when in use for added stability, to level the apparatus if on irregular ground, or to control the level of the towing hitch 5 to connect it to a towing vehicle ball.

The embodiments are preferably fully insulated, self-contained units complete with refrigeration units, or without insulation for installation inside refrigerated vaults. Any of the various embodiments may be used in conjunction with well known auxiliary equipment such as screw conveyors, pneumatic conveyors, snow blowers, baggers or other ice processing or distributing systems.

The foregoing disclosure and description of the invention are illustrative and explanatory thereof, and various changes in the size, shape and materials, as well as in the details of the illustrated construction may be made without departing from the spirit of the invention.

What is claimed is:

1. A mobile ice plant for making and discharging ice at remote locations, comprising:

ice-making means;

a mobile ice storage bin adapted to be disposed underneath said ice-making means to receive ice manufactured by said ice-making means when the ice plant is in its ice-making position;

lifting means for raising and lowering said ice-making means from a storage position within said storage bin to an ice-making position above said storage bin; and ice handling means mounted within said storage bin to discharge ice from said bin.

2. The mobile ice plant of claim 1, wherein said lifting means comprises rotating shafts mounted within said storage bin and cables wound around said shafts and attached to said ice-making means.

3. The mobile ice plant of claim 1, wherein said ice handling means comprises:

first ice moving means for moving the ice stored within the bin to one end of the bin;

ice break-up means mounted on said end of said bin for separating the ice as it moves toward said break-up means; and second ice moving means to transport the separated ice to any subsequent ice handling devices.

4. The mobile ice plant of claim 3, wherein said first ice moving means comprises a plurality of continuous chains traversing power and idler sprockets on the floor of said bin.

5. The mobile ice plant of claim 3, wherein the ice break-up means comprises a plurality of ice-breaker bars mounted on said end of said bin.

6. The mobile ice plant of claim 3, wherein said second ice moving means comprises a screw conveyor mounted under said ice break-up means.

7. A mobile ice plant for making and discharging fragmented ice, comprising:

fragmented ice-making means;

a mobile ice storage bin adapted to be disposed underneath said ice-making means to receive fragmented ice when the ice plant is in its ice-making position;

lifting means for raising and lowering said ice-making means from a storage position within said storage bin to an ice-making position above said storage bin;

first ice moving means for moving the fragmented ice stored within the bin to one end of the bin;

ice break-up means mounted on said end of said bin for separating the fragmented ice as it moves toward said break-up means; and second ice moving means to transport separated ice fragments to any subsequent ice handling devices.

8. The mobile ice plant of claim 7, wherein said lifting means comprises rotating shafts mounted within said storage bin and cables wound around said shafts and attached to said ice-making means.

9. The mobile ice plant of claim 7, wherein said first ice moving means comprises a plurality of continuous chains traversing power and idler sprockets on the floor of said bin.

10. The mobile ice plant of claim 7, wherein the ice break-up means comprises a plurality of ice-breaker bars mounted on said end of said bin.

11. The mobile ice plant of claim 7, wherein said second ice moving means comprises a screw conveyor mounted under said ice break-up means.

12. A mobile ice plant for making and discharging fragmented ice, comprising:

fragmented ice-making means;

a mobile ice storage bin adapted to be disposed underneath said ice-making means to receive fragmented ice when the ice plant is in its ice-making position;

lifting means mounted within said storage bin for raising and lowering said ice-making means from a storage position within said storage bin to an ice-making position above said storage bin;

a plurality of continuous chains traversing power and idler sprockets on the floor of said bin for moving the fragmented ice stored within the bin toward one end of the bin;

a plurality of ice-breaker bars mounted on said end of said bin for separating the fragmented ice as it moves toward said bars; and a screw conveyer mounted under said ice-breaker bars to transport separated ice fragments to any subsequent ice handling devices.

13. The mobile ice plant of claim 12, wherein said lifting means comprises rotating shafts mounted within said storage bin and cables wound around said shafts and attached to said ice-making means.

* * * * *

UNITED STATES PATENT AND TRADEMARK OFFICE

CERTIFICATE OF CORRECTION

PATENT NO. : 4,612,779

DATED : September 23, 1986

INVENTOR(S) : James R. Hatton

It is certified that error appears in the above-identified patent and that said Letters Patent are hereby corrected as shown below:

In column 1, line 21, delete "packe" and insert --packing , bridging and fusing together of the ice pieces during transit . U.S. Patent No. 4,404,817 discloses a satellite ice plant having a storage bin adapted for the storage and distribution of fragmented ice . This Applicant has sold similar ice-- therefor.

Signed and Sealed this

Sixteenth Day of December, 1986

*Attest:*

DONALD J. QUIGG

*Attesting Officer*

*Commissioner of Patents and Trademarks*